United States Patent [19]

Graf

[11] 4,356,598

[45] Nov. 2, 1982

[54] CARD SUPPORT FOR CARDING LAYER

[75] Inventor: Ralph Graf, Freienbach, Switzerland

[73] Assignee: Graf & Cie A.G., Rapperswill, Switzerland

[21] Appl. No.: 133,805

[22] Filed: Mar. 25, 1980

[30] Foreign Application Priority Data

Apr. 20, 1979 [CH] Switzerland ..... 3778/79

[51] Int. Cl.[3] ..... D01G 15/86

[52] U.S. Cl. ..... 19/114

[58] Field of Search ..... 19/114, 113; 474/260, 474/266, 267

[56] References Cited

U.S. PATENT DOCUMENTS

| | | | |
|---|---|---|---|
| 2,619,683 | 12/1952 | Murray | 19/114 |
| 2,800,701 | 7/1957 | Watts et al. | 474/267 |
| 3,290,729 | 12/1966 | Maynard | 19/114 |
| 3,947,922 | 4/1976 | Ibbotson | 19/114 |
| 4,100,006 | 7/1978 | Buckley | 19/114 X |

FOREIGN PATENT DOCUMENTS

| | | | |
|---|---|---|---|
| 709587 | 5/1965 | Canada | 474/267 |
| 709669 | 6/1966 | Italy | 19/114 |
| 309986 | 1/1929 | United Kingdom | 19/114 |
| 362041 | 12/1931 | United Kingdom . | |
| 1349652 | 4/1974 | United Kingdom . | |
| 1405021 | 9/1975 | United Kingdom . | |

*Primary Examiner*—Louis Rimrodt

*Attorney, Agent, or Firm*—Lane, Aitken, Kice & Kananen

[57] ABSTRACT

Card support for carding layers, wherein the teeth are anchored in a base body made of resilient solid plastic, with reinforcing fabric layers embedded in the base body.

This new type of construction is simpler to manufacture than known card supports, has better wear properties, and because of the improved recuperative capacity of the teeth leads to improved carding results.

3 Claims, 2 Drawing Figures

CARD SUPPORT FOR CARDING LAYER

BACKGROUND OF THE INVENTION

1. Field of the Invention

The present invention relates to card supports for carding layers such as used especially in carding machines.

2. Description of the Prior Art

Card supports for carding layers, also known as carding belts, consist of belt-shaped supports in which the teeth, i.e. flexible resilient wires, are set and anchored. Known card supports usually comprise a belt of a number of fabric layers, for instance of cotton fabric vulcanized together, wherein the top is provided with a rubber covering layer. The teeth or wires are anchored in the back of the belt, pass through the fabric layers, and project from the top surface.

These known card supports are relatively expensive to manufacture and subject to quite appreciable wear, especially through the teeth becoming entrained.

SUMMARY OF THE INVENTION

Hence, it is a general object of the present invention to provide a card support of novel construction whereby the existing defects are largely overcome.

Now, in order to implement this and still further objects of the invention, which will become more readily apparent as the description proceeds, the card support for carding layers, wherein teeth are set in the support and anchored, is manifested by the feature that the belt-shaped support consists of a base body made of resilient plastic in which are embedded two reinforcing layers, also of belt shape.

Materials particularly suitable for the base body include polyvinyl chloride, polyurethane, and like materials, with appropriate plasticizers. The reinforcing layers may for example be layers of polyester or polypropylene fabric.

In one particularly suitable embodiment of a card support provided by the invention, the two reinforcing layers, preferably formed as fabric, are embedded in the base body near the top and bottom of the body, respectively.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
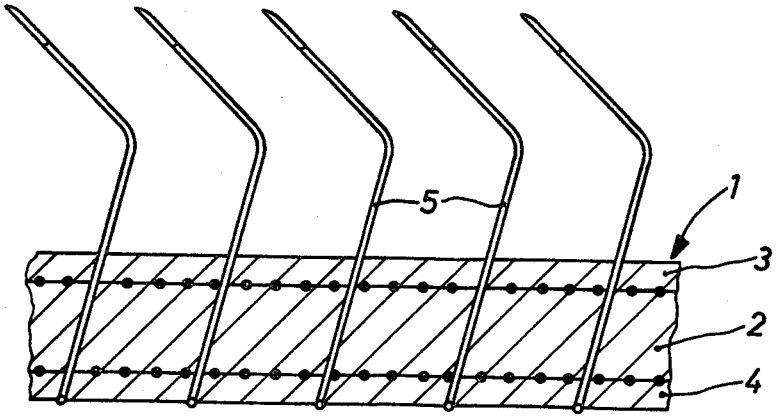
FIGS. 1 and 2 in these drawings show, purely schematically, a longitudinal section and a cross section through part of a card support 1.
Figure 2:
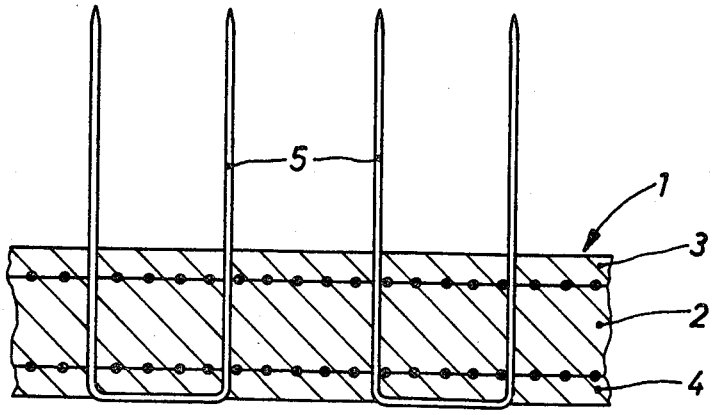

This card support consists of a base body 2 of resilient solid plastic such as PVC, polyurethane, nylon 6 or nylon 6.6, with appropriate plasticizers. Embedded in the base body 2, near the upper and lower sides of the support, relatively, are reinforcing inserts 3 and 4 in the form of fabric layers, preferably also made of plastic, e.g. polyester or polypropylene.

Anchored in the base body 2 are teeth 5. These are held by the resilient material of the base body and also by the loops in the fabrics 3, 4.

The card support is simple to manufacture, which again means lower fabrication costs than previously.

Because of the particular material of the base body, entrainment of the teeth can hardly now occur, which appreciably improves the wear properties. Anchorage of the teeth in a support in accordance with the invention increases the recuperative capacity of the teeth during operation or while vibrating.

These advantages over prior card supports lead to better results in carding machines.

It should be added that the new construction permits a particularly improved regularity in tooth pattern since the teeth are not as hitherto deflected by a multiplicity of fabrics.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An improved card support for carding layers, comprising a base body fabricated from a solid resilient plastic, first and second fabric reinforcing layers embedded adjacent a top surface thereof and the second of said fabric reinforcing layers embedded adjacent the other surface thereof, and a plurality of wire teeth extending through said base body and said fabric layers for support thereby, said teeth being anchored in said support by said resilient plastic material and by loops in said fabric to minimize deflection of said teeth and increase the recuperative capacity of said teeth during operation.

2. A card support as in claim 1, characterized in that the fabric of the layers consist of a plastic selected from the group consisting of polyester or polypropylene.

3. The card support claimed in claim 1 wherein said solid resilient plastic is selected from the group consisting of polyvinyl chloride, polyurethane, polyamide 6, or polyamide 6.6.

* * * * *